US008282447B1

(12) United States Patent
Buser

(10) Patent No.: US 8,282,447 B1
(45) Date of Patent: Oct. 9, 2012

(54) ADAPTIVE DUST SHIELD DEVICE

(76) Inventor: John Buser, San Diego, CA (US)

( * ) Notice: Subject to any disclaimer, the term of this patent is extended or adjusted under 35 U.S.C. 154(b) by 570 days.

(21) Appl. No.: 12/423,186

(22) Filed: Apr. 14, 2009

Related U.S. Application Data

(63) Continuation-in-part of application No. 11/341,138, filed on Jan. 27, 2006, now abandoned.

(51) Int. Cl.
*B24B 55/04* (2006.01)

(52) U.S. Cl. ..... 451/451; 451/455; 451/456; 451/457

(58) Field of Classification Search ..... 451/451–457; 30/514, 516; 144/252.1, 252.2
See application file for complete search history.

(56) References Cited

U.S. PATENT DOCUMENTS

| | | | | |
|---|---|---|---|---|
| 2,819,570 | A | 1/1958 | Tocci-Guilbert et al. | |
| 5,125,190 | A | 6/1992 | Buser | |
| 5,411,433 | A * | 5/1995 | Keller | 451/451 |
| 5,545,082 | A | 8/1996 | Courson et al. | |
| 5,609,516 | A * | 3/1997 | Courson et al. | 451/456 |
| 5,713,785 | A | 2/1998 | Nishio | |
| 6,354,408 | B1 * | 3/2002 | Bailey et al. | 188/73.39 |
| 6,726,554 | B1 | 4/2004 | Chen et al. | |
| 2001/0049258 | A1 * | 12/2001 | Erdogan et al. | 451/389 |
| 2005/0079808 | A1 * | 4/2005 | Tiede et al. | 451/357 |

* cited by examiner

*Primary Examiner* — Robert Scruggs
(74) *Attorney, Agent, or Firm* — Steins & Associates, P.C.

(57) ABSTRACT

An adaptive dust shield for rotary grinders having a bearing housing and an axial groove around the bearing housing. The dust shield has a cover and a plurality of upstanding flexible fingers, in multiples of four, which extend upward from and around the top of the cover. These flexible fingers have a defined width and are separated apart from each other defining a space between each one of the flexible fingers. The width of the space is less than the defined width of the flexible fingers.

A stretchable fitting ring fits onto the bearing housing of the grinder and into the flexible fingers. The flexible fingers are secured onto the stretchable fitting ring by a securing fastener. Tightening the securing fastener over the flexible fingers compresses them into the stretchable fitting ring and the stretchable fitting ring into the groove of the bearing housing of the grinder forming a secure attachment.

21 Claims, 6 Drawing Sheets

ADAPTIVE DUST SHIELD DEVICE

CROSS REFERENCES TO RELATED APPLICATIONS

This application is a continuation-in-part of nonprovisional application, application Ser. No. 11/341,138, filed on Jan. 27, 2006 now abandoned.

STATEMENT REGARDING FEDERALLY-SPONSORED RESEARCH OR DEVELOPMENT

None

BACKGROUND

This device relates to an improvement in the field of power hand tools, and more particularly to rotary tools which generate large amounts of dust and particulate debris.

Rotary grinders and similar rotary power tools are used extensively in industry. More specifically angle type grinders/sanders having grinding discs or pads, are used for grinding concrete, fiberglass, wood, steel, removing asbestos, and body filler in automobile shops. Such grinders/sanders are also used for making boats and similar products. In use these grinders create large quantities of dust that are both a fire hazard and a health hazard. Wood dust, for example, can be very explosive over a wide range of concentrations and is a known fire hazard. Hot metal grindings are particularly dangerous as fire starters. Both wood dust and metal filings as well as asbestos particles, fiberglass and body filler particles create known health hazards to users of the grinders and to others in the immediate environment. It is known that concrete dust, as typically generated in great quantities from grinding concrete, is a principal cause of pulmonary silicosis.

Grinder discs and pads often rotate in excess of 7,000 revolutions per minute (RPM). Grinding pads that use a sponge type backing material create a hazard where parts or particles from the backing material break off and are shot from the rotating disc tangently at a high rate of speed. It is often necessary to use a rotary grinder to grind into corners or against surfaces that have side edges, that can cause particles of the foam backing material to break off from the high speed rotating disc and hit the operator or other persons or equipment in the immediate area.

A dust shield described in U.S. Pat. No. 5,125,190 approached this problem and solved it to some extent. It has an upstanding attachment collar [reference character 16 of U.S. Pat. No. 5,125,190] which was diametered to fit onto the bearing housing [reference character 38 of U.S. Pat. No. 5,125,190] of a variety of different grinders. Different make grinders have different diameters for their respective bearing housing. Typical diameters of bearing housing range from one and one-half inch to three inches. A one-size attachment collar on the dust shield would not accommodate the different bearing housings. Consequently, several different models of the dust shield, each having different collar diameters, had to be manufactured for the various make grinders or requires an adapted. This, of course, increases manufacturing costs and adds to inventory of a supplier and end-user since most end-users have more than one grinder and more than one make.

Without the adapter, the retailer generally must carry up to 40 SKUs (stock keeping units) to cover all the grinders made. With the adapter, the retailer will need only 6 stocking units, one for each of the major disc diameters of 2, 3, 5, 6, 7 and 8 inches. Space in a retail store is very valuable. This adds value to the adapter because it can reduce the amount of space needed to provide a line of dust shields that can fit all grinders.

Additionally, the grinding surface of different brands of grinders with different grinding disks varies in distance from the bearing housing of the grinder where the dust shield is attached. The dust shield of U.S. Pat. No. 5,125,190 was not readily capable of a distance adjustment to bring the grinding surface down to where it can be of effective use or, in some cases, any use at all. The collar (reference character 16 of U.S. Pat. No. 5,125,190) had to be individually and carefully sanded down such that its lower edge (reference character 35 of U.S. Pat. No. 5,125,190) was accordingly raised thereby bringing the grinding surface out to point of use. Cutting the skirt, improper sanding, or improper measurements would in essence ruin the dust shield and be a waste of time and money.

My co-pending application and the new adaptive dust shield, in particular, solves the problems associated with various make of grinders as to different bearing housing diameters and different distance adjustments. The fitting ring and a modified dust shield of the adaptive dust shield will solve the onerous need to produce and inventory up to 40 dust shields to cover all the grinders commercially available and the need for the operator to modify the structure of the adaptive dust shield to accommodate different thicknesses of grinding disks and different bearing housing to disk surface dimensions. Additionally, it is simpler in construction, application, and use.

Additionally, the formulation for the manufacture of the adaptive dust shield is such that, if cutting the adaptive dust shield is necessary, it can easily be cut with ordinary household scissors without ruining the adaptive dust shield in its entirety. The formulation for the manufacture provides for greater flexibility, particularly where most critical, thereby eliminating much of the need to make distance adjustments of the fitting ring into and away from the bearing housing and into and away on the upstanding fingers.

The formulation also is such that it renders the adaptive dust shield of this present device more durable and virtually incapable of being damaged in extremely cold climates, even in temperatures as low as −20° Fahrenheit. Lastly, the fitting ring of this adaptive dust shield is flexible and with the cutouts, can easily fit onto any diameter bearing housing from one and one-half inches to over three inches if necessary.

The foregoing has outlined some of the more pertinent objects of the adaptive dust shield. These objects should be construed to be merely illustrative of some of the more prominent features and applications of the adaptive dust shield. Many other beneficial results can be attained by applying the disclosed adaptive dust shield in a different manner or by modifying the adaptive dust shield within the scope of the disclosure. Accordingly, other objects and a fuller understanding of the adaptive dust shield may be had by referring to the summary of the adaptive dust shield and the detailed description of the preferred embodiment in addition to the scope of the adaptive dust shield defined by the claims taken in conjunction with the accompanying drawings.

SUMMARY

The above-noted problems, among others, are overcome by the adaptive dust shield of this disclosure. Briefly stated, the adaptive dust shield is generally for rotary grinders having a bearing housing and an axial groove around the bearing housing. The adaptive dust shield has a cover with a defined diameter and may, but need not have, an upstanding collar with a Width-X on top of the cover where Width-X is substantially less than said defined diameter.

A plurality of upstanding flexible fingers with a Height-H and in multiples of four extend upward from the top of and around the upstanding collar. In the embodiment without an upstanding collar, the plurality of upstanding flexible fingers extend upward and around the top of the cover. In the embodiment having an upstanding collar, these upstanding flexible fingers have an inside diameter of Width-A where Width-A is substantially less than said Width-X. In embodiments without an upstanding collar Width-A is substantially less than the defined diameter of the cover.

In either embodiment, these plurality of upstanding flexible fingers have a Width-W2 and are separated apart from each other defining a space between each one of these plurality of upstanding flexible fingers wherein this space has a Width-W1 and wherein Width-W1 is less than Width-W2.

A stretchable, rubber-like fitting ring is adapted to be stretched if necessary and to fit onto the bearing housing of the grinder. The outside diameter of the fitting ring is adapted to fit into the plurality of upstanding flexible fingers. Being flexible, the plurality of upstanding flexible fingers may flex inward, toward the fitting ring, or outward, away and around the outside diameter of the fitting ring, and be secured onto the fitting ring by a suitable securing fastener. Tightening the securing fastener over the upstanding flexible fingers compresses them into the fitting ring and the fitting ring into the groove of the bearing housing of the grinder.

The foregoing has outlined the more pertinent and important features of the adaptive dust shield in order that the detailed description that follows may be better understood so the present contributions to the art may be more fully appreciated. Additional features of the adaptive dust shield will be described hereinafter which form the subject of the claims. It should be appreciated by those skilled in the art that the conception and the disclosed specific embodiment may be readily utilized as a basis for modifying or designing other structures and methods for carrying out the same purposes of the adaptive dust shield. It also should be realized by those skilled in the art that such equivalent constructions and methods do not depart from the spirit and scope of the adaptive dust shield as set forth in the appended claims.

BRIEF DESCRIPTION OF THE DRAWINGS

For a fuller understanding of the nature and objects of the adaptive dust shield device, reference should be had to the following detailed description taken in conjunction with the accompanying drawings in which.

DETAILED DESCRIPTION

Figure 1:
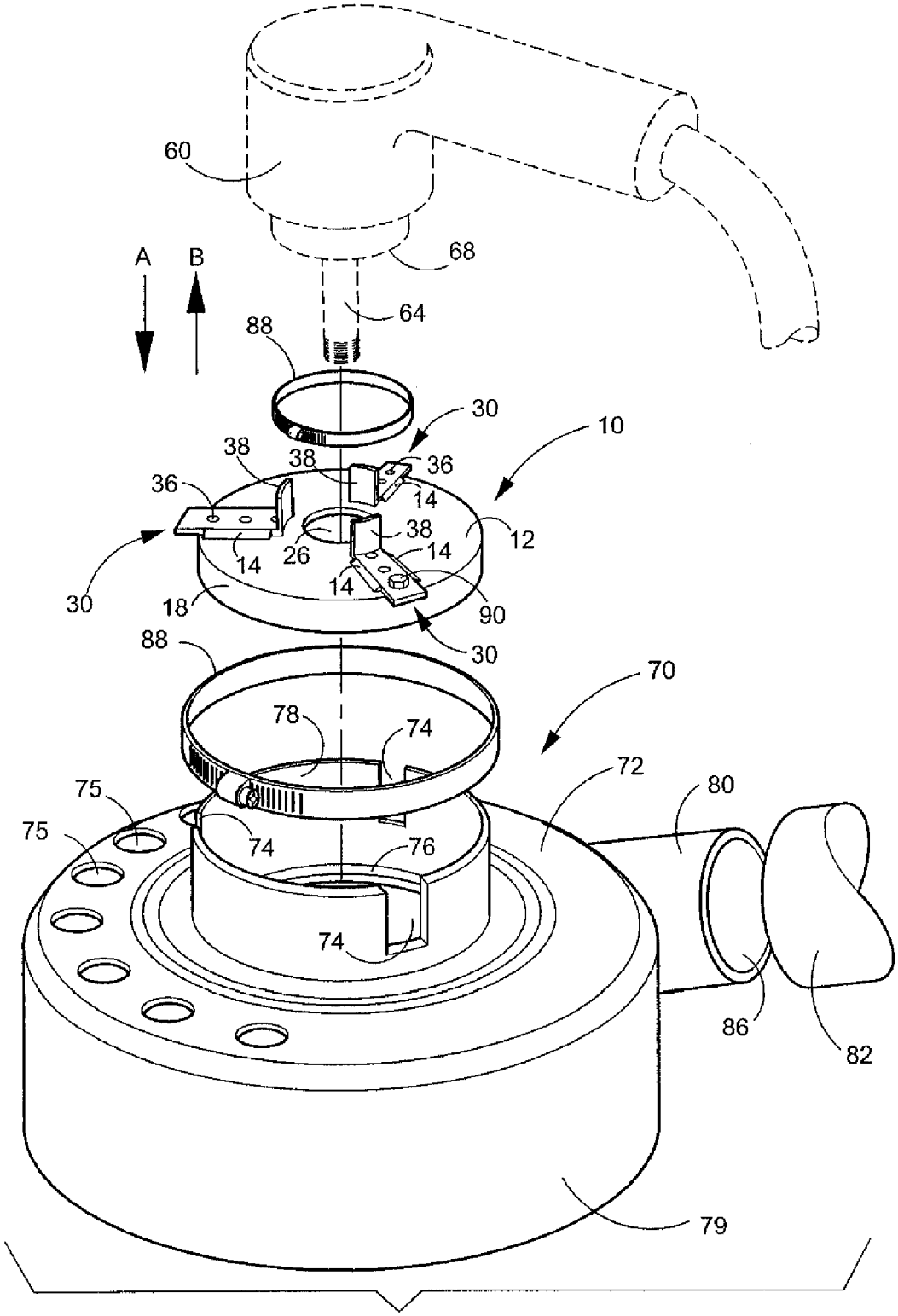
FIG. 1 is an exploded view of the dust shield, adapter, and grinder combination as set forth in my co-pending application.
Figure 2:
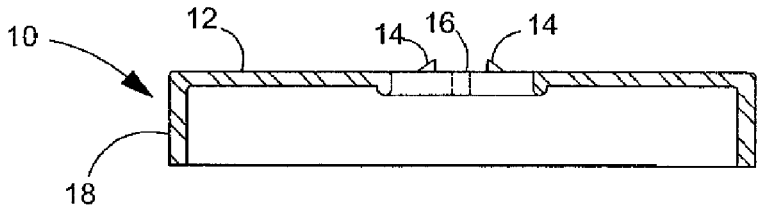
FIG. 2, as taken on line 2-2 of FIG. 3, is a cut-away view of the adapter without brackets as set forth in my co-pending application.
Figure 3:
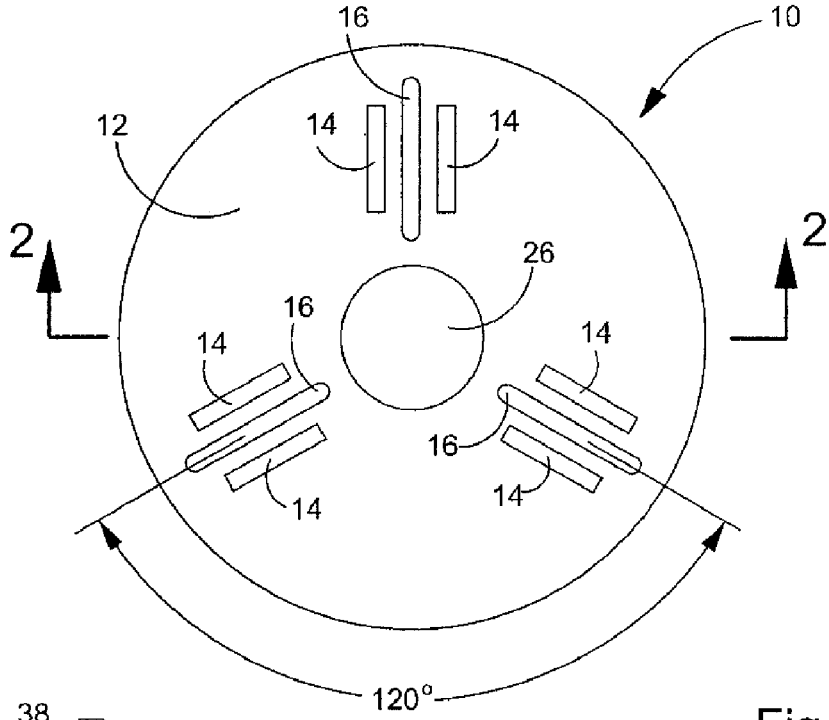
FIG. 3 is a top plan view of the adapter without brackets as set forth in my co-pending application.
Figure 4:
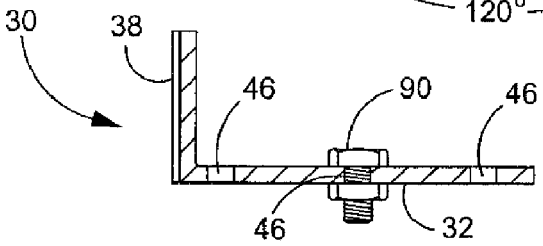
FIG. 4, as taken on line 4-4 of FIG. 5, is a side elevation cut-away view of a bracket as set forth in my co-pending application.
Figure 7A:
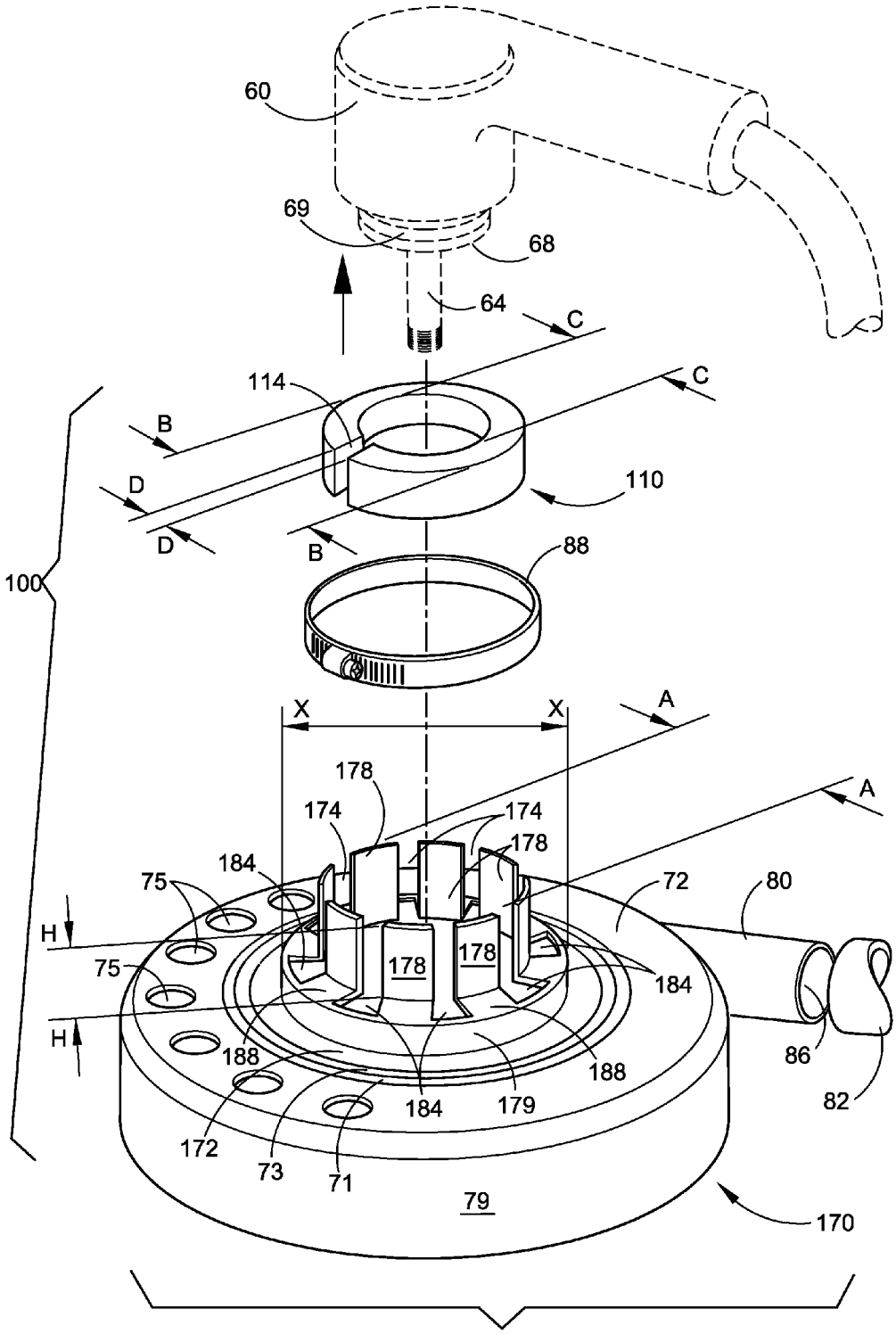
FIG. 7A is an exploded perspective view of the adaptive dust shield device of this present application.
Figure 7B:
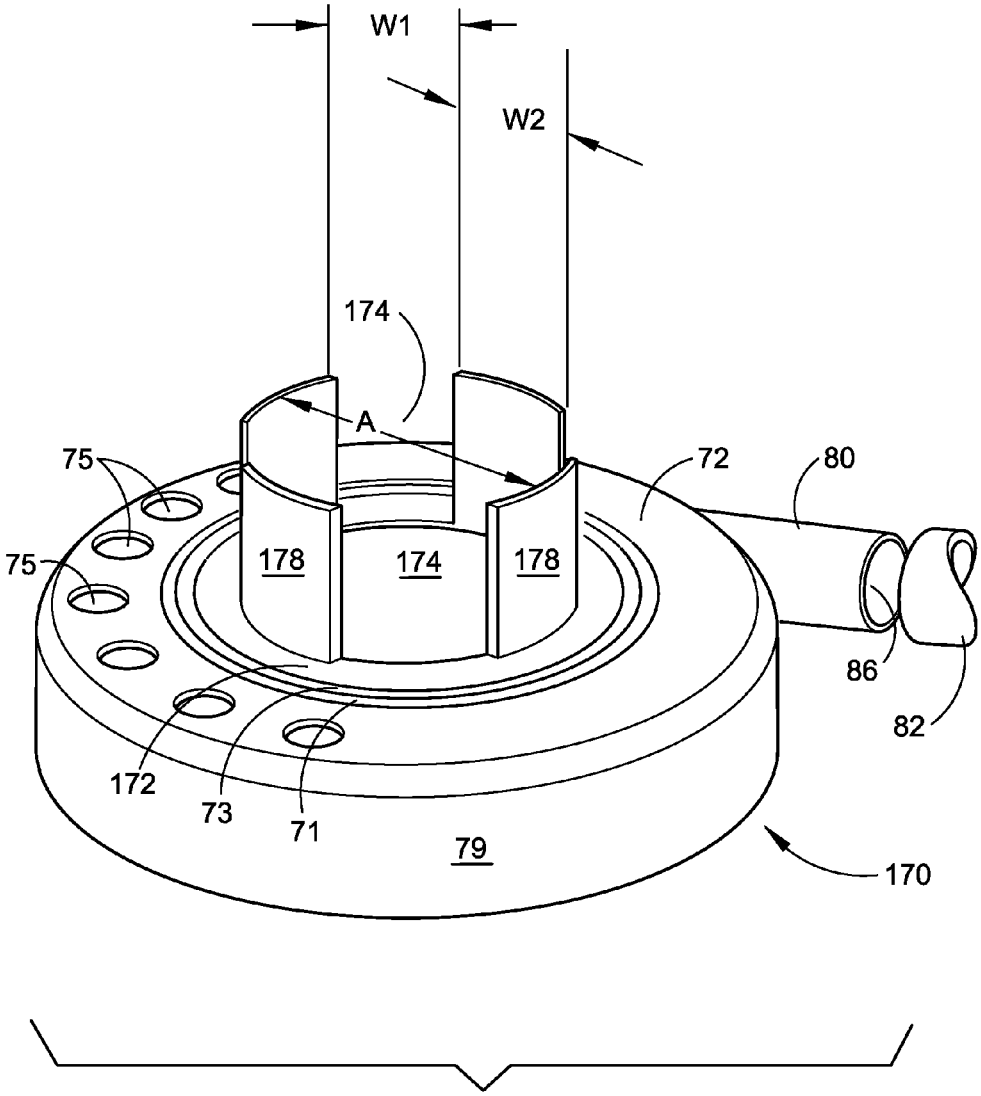
FIG. 7B is a detailed view a second embodiment of the adaptive dust shield device of this present application.
Figure 8:
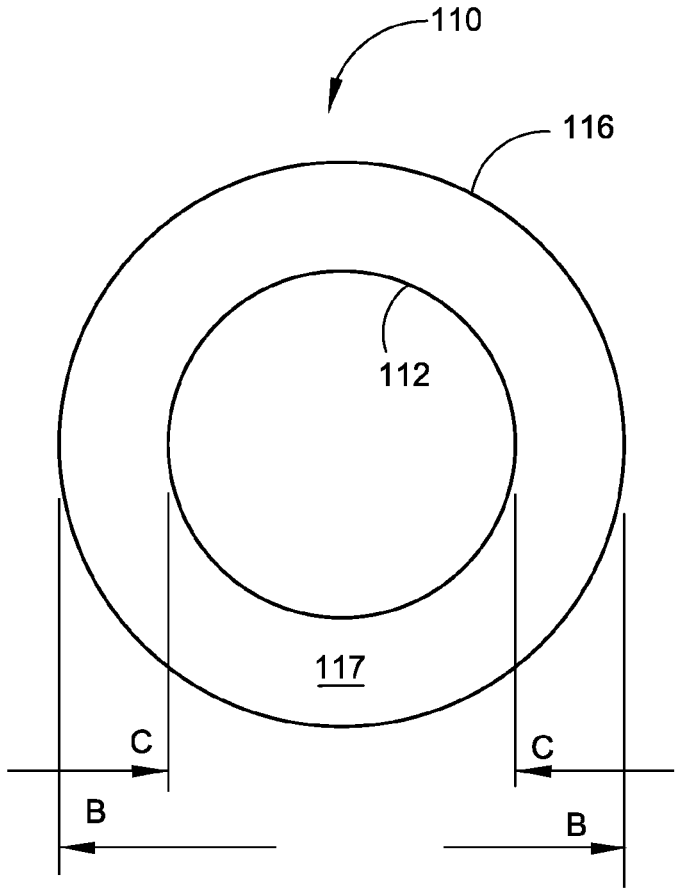
FIG. 8 is a top plan view of the fitting ring for attaching the adaptive dust shield to a grinder.
Figure 9:
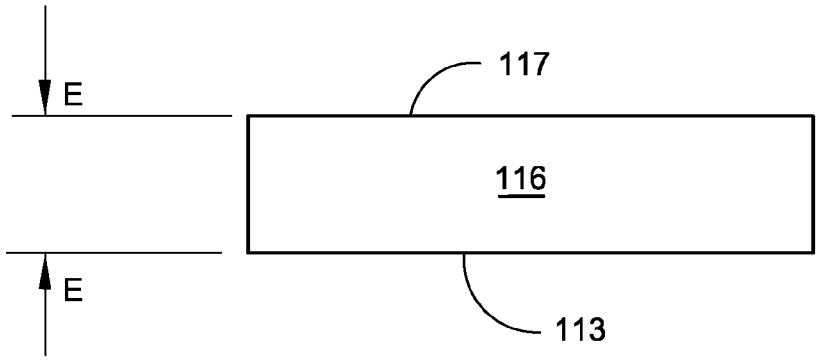
FIG. 9 is a side elevation view of the fitting ring for attaching the adaptive dust shield to a grinder.
Figure 10A:
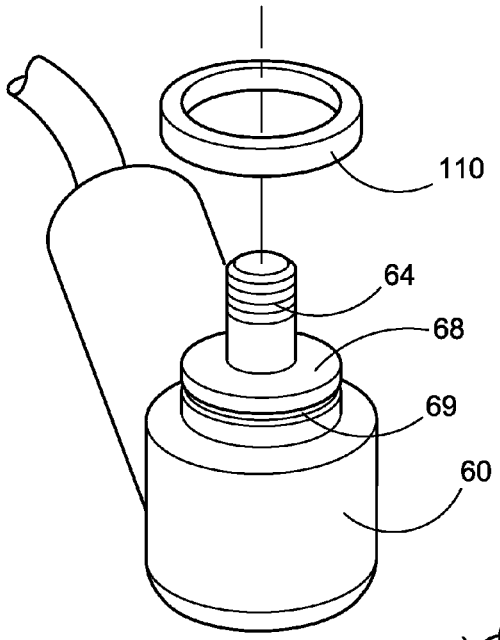
FIGS. 10A and 10B are detailed views on the method associated with mounting the adaptive dust shield to a grinder.
Figure 10B:
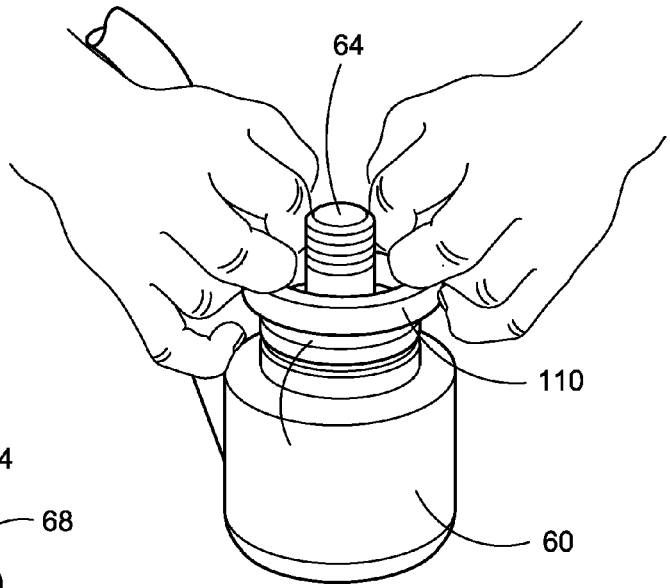
Figure 10C:
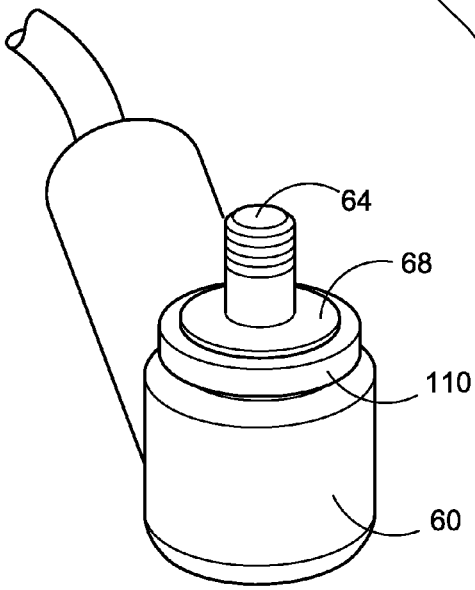

FIGS. 1 through 6 are representative of the features set forth in my co-pending application and are provided here in detail, and as otherwise may be necessary, to assist in the understanding of my current novel adaptive dust shield as illustrated in FIGS. 7 through 9. FIG. 1, reference character 10 and 70 generally designates an adapter and dust shield constructed in accordance with a preferred embodiment of my co-pending application. This dust shield 70 has an upper surface 72 with an integral downward projecting skirt 79. A plurality of air vents 75 for vacuum relief may, but need not, be fashioned around the upper surface 72 of the dust shield 70.

Projecting upward of the upper surface is a collar 78 with cut-outs 74. The dust shield 70 can be made of a translucent or transparent molded plastic, fiberglass, metal, or of any other suitable material though best results can be attained by manufacturing the dust shield 70 with the unique formulation described below. The collar 78 should be flexible and the unique formulation described below provides for greater flexibility and, if necessary, trimming of the collar 78 if necessary.

As illustrated in FIG. 1, the cut-outs 74 which define the collar 78 show three upstanding walls for the collar 78 with three cut-outs 74 in between these three upstanding walls. These upstanding walls forming the collar 78 should be of sufficient flexibility to permit them to translate, or squeeze inward as the clamp 88 is tightened around the collar 78. With a sufficient diameter bearing housing 68 on the grinder 60, and with the flexibility of the collar 78, the adapter 10 associated with this dust shield 70 may be eliminated. The height of the collar 78 should also range from approximately one-half inch to about two inches.

A unique feature of this dust shield 70 is the cut-outs 74 in the collar 78. The cut-outs 74 are aligned with the respective bracket base 32 [see FIG. 4]. The function of the cut-outs 74 is to accommodate that portion of the bracket base 32 which extends outward of the downward projecting wall 18 of the adapter 10 after the adapter 10 has been attached to the bearing housing 68. If the bracket base 32 does extend outward after attachment, each portion so extending will slip into the respective cut-out 74 and may be moved down into the cut-out 74 as needed for distance adjustment. Once the proper distance adjustment is attained for the brand grinder being used, the collar 78 may be secured to the adapter 10.

The preferred embodiment of this dust shield 70 may comprise a unique formulation of a copolymer polypropylene, a no-break copolymer polypropylene, produced by Huntsman and bearing trade number 18S2A and a thermoplastic elastomer produced by DSM TPE, Inc., bearing the trademark Sarlink. The preferred ratios of these products is approximately 75% of the copolymer polypropylene and approximately 25% of the thermoplastic elastomer. This type of manufacture may also apply to, but need not, the improved adaptive dust shield device of this present disclosure.

The skirt 79 of the dust shield 70 also has an exhaust opening 86 connected to an exhaust port 80 that is aligned tangently with the skirt 79. An external hose 82 attaches to the exhaust port 80. The external hose 82 typically is part of a vacuum or vacuum system [not shown] to draw out ground or sanded particles.

As described above, the upper surface 72 has an attachment collar 78 which houses or receives the adapter 10. The collar 78 encircles a hole or opening 76 in the upper surface 72. In one embodiment of my co-pending application, the adapter 10 is an integral part of the dust shield 70 permanently affixed to it at or adjacent to the collar 78. In this type embodiment, the collar 78 need not, but may, have cut-outs 74 in that the adapter 10, being integral to the dust shield 70, is thereby incapable of distance adjustment.

In another and preferred embodiment of my co-pending application, the adapter 10 is a separate unit, as clearly illustrated in FIG. 1, which is placed into the collar 78 of an existing dust shield 70 and secured thereat with a suitable fastener such as, but not limited to, a hose-type clamp 88 with setting screw placed and used around the collar 78. A typical grinder 60 has bearing housing 68 and arbor or drive shaft 64. Whether a separate unit or part of the dust shield, the adapter 10 is fitted onto and secured to the bearing housing 68 with a set of at least three adjustable brackets 30 and a hose-type clamp 88. When the adapter 10 and dust shield 70 are fitted to the grinder, the arbor 64 of the grinder 60 projects through the opening 26 in the adapter 10 and through the opening 76 in the dust shield 70. In this position, a hose type clamp 88 and setting screw tightens the brackets 30 and onto the bearing housing 68 to hold the dust shield 70 to the grinder 70.

In my co-pending application, where the adapter 10 is a separate and removable unit from the dust shield 70, the attachment collar 78 may have any desired diameter or may be of a flexible material attached to the upper surface 72 of the dust shield 70. Its flexibility will accommodate the insertion of the wall 18 of the adapter 10 inside the collar 78 and further accommodate a suitable securing member, such as a hose clamp 88, to secure the adapter 10 to the dust shield 70. It should be understood that in this separate component embodiment, the adapter walls 18 may vary in diameter to accommodate varying diameter collars 78 as, and if, necessary. In addition, the collar 78 in this separate component embodiment also has the cut-outs 74 as described above.

Since the adapter 10 has adjustable brackets 30, the adapter 10 is capable of being secured to any diameter bearing housing which ranges in diameter from one and one-half inches to over three inches. Additionally, because of this adjustability, in a dual component embodiments [i.e., separate unit dust shield and separate unit adapter] only a single size diameter for the collar 78 on the dust shield 70 and similar size diameter for the wall 18 of the adapter 10 is necessary thereby eliminating the need to manufacture various sizes of dust shields and adapters. A one-size collar 78 will fit all grinders by use of this combination dust shield 70 and adapter 10.

FIG. 1 illustrates the dust shield 70 of my co-pending application in combination with the adapter 10 and the grinder 60. This is illustrated in exploded to show a dual-component device having a separate detachable adapter 10 and a separate detachable dust shield 70 and to also illustrate a single-component device where the adapter 10 is an integral part of the dust shield 70 [in such case the hose clamp 88 around the collar 78 is not necessary].

The adapter 10 of my co-pending application is illustrated in greater detail in FIGS. 2 through 6. The top surface 12 of the adapter 10 has an opening 26 through which the arbor 64 of the grinder 60 passes. This top surface 12 also has three axial slots 16 approximately 120° from each other. A guide such as a ridge or berm 14 is fashioned on each side of each slot 16. A wall 18 projects downwardly from the top surface 12. In embodiments where the dust shield 70 and adapter 10 are separate detachable components, the wall 18 of the adapter 10 is sized to fit into the collar 78 of the dust shield 70 and is secured thereat by a suitable fastener, such as, but not limited to a hose-type clamp 80 with set screw.

Sliding adjustable brackets 30 complete the adapter 10 of my co-pending application. Each bracket 30 has a base 32 and a gripper 38 upstanding from the front of the base 32. Each bracket 30 further has two or more apertures 46 in the base 32. The width of each base 32 is such that the bracket 30 will slidingly fit over the slot 16 and slidingly in between the pair of berms 14 adjacent to its respective slot 16. The edges of the base 32 should abut the berms 14 thereby permitting accurate axial movement to and from the center of the opening 26 on the top surface 12 of the adapter 10.

The apertures 46 on the bracket 30 are aligned with the slot 16. Suitable fasteners 90, such as but not limited to a nut and bolt or similar combination, are fitted through the apertures 46 and tightened to the point of retention of the bracket in the berm 14 and slot 16 combination while permitting the bracket 30 to be slid thereon back and forth as necessary to abut the bearing housing 68 of the grinder 60 to which the adapter 10 is being attached. A hose clamp 88 is placed over the adapter 10 on the backs of the gripper 38 and tightened around the bearing housing 68. Once the gripper 38 of the bracket 30 abuts the bearing housing 68 the adapter 10 is centered to the axis of rotation of the arbor 64, the hose clamp 88 is secured, and the fasteners 90 in the apertures 46 may be more securely tightened.

A distance adjustment of any distance from about one-fourth of an inch to about one and one-fourth inches may be made as necessary to bring the grinding surface down or out [in the directions of Arrows A and B] to the required point of contact. As described above, this is facilitated by the cut-outs 74 in the collar 78 which permit insertion of the bracket base 32 if the bracket base 32 extends outward beyond the downward projecting wall 18 and further permits downward movement for distance adjustment as necessary.

Figure 5:
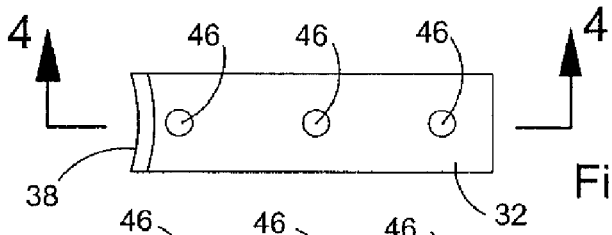
FIG. 5 is a top plan view of a bracket as set forth in my co-pending application.
Figure 6:
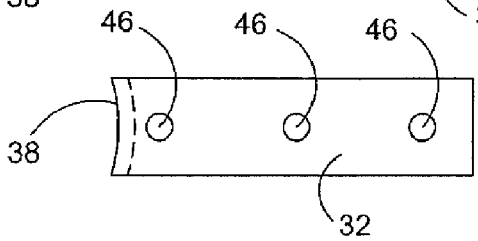
FIG. 6 is a bottom plan view of a bracket as set forth in my co-pending application.

The leading edge of the gripper 38 may be slightly curved as illustrated in FIGS. 5 and 6. A curved surface has proven to be more effective in securing the adapter 10 to the bearing housing 68 of the grinder 60.

Turning now to FIGS. 7A through 9, reference character 100 is illustrative of the preferred embodiment of the adaptive dust shield device of this disclosure. Some of the component parts of the device of my co-pending application, and their function and structure, are similar to the corresponding component parts of this adaptive dust shield device 100. To the extent such is the case, the disclosure above is incorporated by reference herein.

The adaptive dust shield device 100 as illustrated in FIG. 7A has a cover 170, generally circular in structure, having a defined diameter. The cover 170 is adapted to fit over and completely cover a disk [not shown] when attached to a grinder 60. Typical grinders 60 have a bearing housing 68 and an extending arbor 64. Not unlike the dust shield 70 of my co-pending application, this cover 170 has an upper surface 72 of substantial width and inward thereof angled slopes 71, 73, to facilitate and maintain vertical flexibility for the adaptive dust shield device 100 when attached to a grinder 60.

As with my co-pending application, a plurality of air vents 75 for vacuum relief may, but need not, be fashioned around the top of the of the cover 170. In some instances there is sufficient vacuum relief from either the angled slots 184, as seen in FIG. 7A, or from the spaces 174 between the upstanding fingers 178.

At the inner-most end of the angled slopes 71, 73 there is an inward extending landing 172 terminating at a point where a circular collar 179 extends upward from the landing 172. The circular collar 179 has a diameter bearing Width-X wherein Width-X is substantially less than the defined diameter of the cover 170. At the top of the circular collar 179, and extending inward, is a ledge 188.

At the inner-most extension of the ledge 188 are a series or plurality of upstanding fingers 178 [referred to as the collar 78 in FIG. 1 of my co-pending application]. These upstanding fingers 178 generally form a circular pattern around the perimeter of the inner-most extension of the ledge 188. As so formed, the upstanding fingers 178 have an inside diameter A-A bearing Width-A wherein Width-A is less than Width-X. A well-defined space 174 [referred to as the cut-outs 74 in FIG. 1 of my co-pending application] separates each one of the plurality of upstanding fingers 178.

The adaptive dust shield device 100 illustrated in FIG. 7B, however, does not have the ledge 188 as described above. The upstanding fingers 178 here extend upward directly from the landing 172. As with the embodiment illustrated in FIG. 7A, Width-A is substantially less than the defined diameter of the cover 170.

The upstanding fingers 178 have a significant height bearing a Height-H [which is represented in FIG. 7A as reference characters H-H]. Height-H should be equal to or greater than the height or thickness of the fitting ring 110 which bears a Height-E [which is represented in FIG. 9 as reference characters E-E] and should be of sufficient height to allow for vertical adjustments of the adaptive dust shield device 100 onto varying sizes of grinders.

The upstanding fingers 178 and spaces 174, as represented in FIG. 1 as collar 78 and cut-outs 74, should be sufficiently flexible in all embodiments of the dust shield 70 [FIG. 1] and cover 170 [FIGS. 7A, 7B]. Material for manufacture suited for the intended purposes includes, but is not limited to, rubber, vinyl, stretchable polymers, or a unique formulation of a copolymer polypropylene, a no-break copolymer polypropylene, produced by Huntsman and bearing trade number 18S2A and a thermoplastic elastomer produced by DSM TPE, Inc., bearing the trademark Sarlink. The preferred ratios of these products is approximately 75% of the copolymer polypropylene and approximately 25% of the thermoplastic elastomer.

In FIG. 1, a minimum or multiple of 3 "fingers" is preferred for that particular embodiment. Experience has shown that multiples of 4 such upstanding fingers 178 in the embodiments represented in FIGS. 7A and 7B provide for better results because they can adapt easily to both round bearing housings 68 or square bearing housings [not illustrated].

In FIG. 7B, the width of the spaces 174 is represented as Width-W1 and the width of the upstanding fingers 178 is represented as Width-W2. The widths stated herein are important for a good gripping of the cover 170 to the grinder 60. For good gripping capacity of the cover 170 onto the bearing housing 68, the ratio of Width-W1 to Width-W2 should range from approximately 1.00:1.25 to approximately 1.00:1.75. Best results have been found from a ratio of approximately 1.00:1.56.

This permits for expansion of Width-A as necessary in cases where the bearing housing 68 exceeds Width-A and permits for sufficient contraction [squeezing and gripping] of the upstanding fingers 178 onto and over the bearing housing 68 having a smaller diameter than Width-A without causing an overlap or crimping of upstanding fingers 178 onto one another which, if such occurs, would minimize the gripping capacity necessary to maintain the cover 170 onto the grinder 60 and thereby diminish its functionality.

As configured and illustrated in FIG. 7A, angled slots 184 are formed on the ledge 188 which conform to the spaces 174 between the upstanding fingers 178. The angled slots 184 are not necessary to the configuration illustrated in FIG. 7B. Either configuration allows for inward movement of the upstanding fingers 178 when the fitting ring 110 and bearing housing 68 combined have a significantly smaller width than Width-A.

A securing fastener 88, such as, but not limited to, a hose clamp or similar securing device, is placed over the outside of the upstanding fingers 178 while the fitting ring 110, in communication with the bearing housing 68, are inserted inside the upstanding fingers 178. As the securing fastener 88 is tightened, the upstanding fingers 178 will compress or bend inward until such time when all the components [fitting ring 110 over bearing housing 68 and fitting ring 110 with bearing housing 68 on the inside surface of the upstanding fingers 178] are tightly squeezed together.

The bendability of the upstanding fingers 178 also permits the upstanding fingers 178 to flex outward as necessary in such cases where the fitting ring 110 and bearing housing 68 combination have a width which is greater than Width-A. In such cases, generally, the fitting ring is not necessary.

FIG. 7A clearly illustrates the mechanics of the combination of cover 170 with upstanding fingers 178 receiving the fitting ring 110 with the grinder 60 being inserted into and to be held by the fitting ring 110 at the bearing housing 68 of the grinder 60.

The fitting ring 110 has an inner wall 112 with an inside diameter Width-C represented by reference characters C-C in FIG. 8. Its has an outer wall 116 with an outside diameter Width-B represented by reference characters B-B also in FIG. 8. The fitting ring 110 has top surface 117 and bottom surface 113 whose height [Height-E] is also represented by reference characters E-E in FIG. 9.

FIG. 7A also illustrates a clearly defined opening 114 from top surface 117 to bottom surface 113 and from the outer wall 116 clear through to the inner wall 112. This opening 114 may, but need not be angled as illustrated in the figure and represented by reference characters D-D.

The fitting ring 110 may be of varying sizes such that its outside diameter B-B [Width-B] should be nearly equal to or lesser than the inside diameter A-A [Width-A] of the encircling upstanding fingers 178. The inside diameter C-C [Width-C] of the fitting ring 110 should be nearly equal to or substantially less than the diameter of any given bearing housing 68. The fitting ring 110 may, but need not have the opening 114 as shown in FIG. 7A but not in FIG. 8.

The inside diameter [Width-C] of the fitting ring 110 should be roughly the same as the smallest commercially available bearing housing 68; i.e., from approximately 1.50 inches to approximately 2.00 inches. The fitting ring 110 should be made of a stretchable material [like a rubber band] or a flexible material such that it will fit over bearing housing 68 diameters which are greater than the inside diameter of the fitting ring 110.

For instance, a fitting ring 110 with an inside diameter of 2.0" can be stretched or flexed over a bearing housing 68 diameter of 2.5" with very little difficulty. This is important because it offers universality to the fitting ring 110 in that it will fit a wide range of bearing housing 68 diameters.

In some cases the fitting ring 110 is not necessary because the diameter of the bearing housing 68 is significantly close to Width-A of FIG. 7A such that the flexibility of the upstanding fingers 178 will compress to form a secure bond with the bearing housing 68 without pinching off the hose clamp 88 from the upstanding fingers 178.

This pinch-off complicates manufacture of dust shields in that, many different diameters of Width-A for upstanding fingers need to be produced in order to accommodate the varying sized diameters for the bearing housings of grinders. For example, 4-inch to 5-inch grinders generally have a bearing housing which varies from about 1.5-inches to 2.0-inches whereas 7-inch to 8-inch grinders generally have a bearing housing which varies from about 1.75-inches to about 2.90-inches. In all prior art devices which have used "upstanding fingers" the fingers were molded to fit bearing housings within a limited range of diameters for the fingers.

If a diameter of a bearing housing is too small in relation to the diameter of the upstanding fingers, securing the upstanding fingers to the bearing housing will result in the securing member [generally a hose clamp] to slide off the upstanding fingers; i.e., pinch-off. If on the other hand, the bearing housing diameter was substantially larger than the diameter of the upstanding fingers, the upstanding fingers would resist application of the securing member and the upstanding fingers would "push back" on the bearing housing resulting in the dust shield being slid off the bearing housing.

Width-A of applicant's adaptive dust shield is generally set to be close to the largest diameter of the bearing housings of the largest grinders. As such, Width-A [upstanding flexible fingers 178] of applicant's adaptive dust shield should generally range from approximately 2.00-inches to about 3.00-inches. It thereby, and if necessary with application of the stretchable fitting ring 110, can virtually accommodate all diameter sizes of bearing housing and not cause a pinch-off of the fingers or sliding off of the dust shield. Use of the stretchable fitting ring 110 where necessary builds up small diameter bearing housings to allow the upstanding flexible fingers to compress and secure, with application of the securing member, the dust shield to virtually any grinder.

In cases where the bearing housing 68 diameter is less than Width-C, the fitting ring 110 may be cut and a section taken out of it such that it will clamp tightly around the bearing housing 68 having the smaller diameter. Because of the flexibility of the fitting ring 110, it can almost always be stretched over bearing housings 68 with diameters larger than Width-C.

The fitting ring 110 with opening 114 is suitable when the diameter of the bearing housing 68 is substantially less than Width-C of the fitting ring 100. The user may either obtain a fitting ring 110 with the opening 114 or, because of the composition of the fitting ring 110, cut out a suitable opening to thereby allow for the fitting ring to encircle the bearing housing 68 to then accept the cover 170 and upstanding fingers 178 over the fitting ring 110 to be secured onto the bearing housing 68.

In cases where the respective diameters [i.e., bearing housing 68 to fitting ring 110 Width-C, and fitting ring 110 Width-B to upstanding fingers 178 Width-A are significantly incompatible for proper securing of the cover 170 to the bearing housing 68, more than one fitting ring 110, with or without opening 114, may be used.

The most suitable materials for the fitting ring 110, for the functions above described of stretching and flexing and compressing, include, but are not limited to, any flexible vinyl or rubber compositions of such flexibility to permit an expansion or stretching of the fitting ring 110, a cutting of the fitting ring 110, and a compression of the fitting ring when the clamp 88 is tightened around the upstanding fingers 178 to permit the upstanding fingers to compress into and "grip" the fitting ring 110 and for the fitting ring 110 to compress around the bearing housing 68 and, very importantly, into the groove 69 in the bearing housing 68 of most conventional grinders 60.

This gripping, compression by the upstanding fingers 178 into the fitting ring 110 and of the fitting ring 110 into the groove 69 creates a clearly defined "mechanical connection" among all the components and prevents any rotational or vertical movement of the cover 170 around the fitting ring 110 or around the bearing housing 68. The groove 69 of typical grinders 60 generally is an annular groove as depicted in FIG. 7A and perpendicular to the axis of rotation or may be a slot-type groove which is parallel to the axis of rotation. In either case, the mechanical connection as described above is effected.

The method of this disclosure also illustrates a novel approach to solving a persistent problem associated with grinders of different sizes and different sized bearing housings. Except for my co-pending application and its unique adapter, there is be no single dust shield to accommodate all or most of all such varying-sized grinders. This method solves that problem and particularly in association with the adaptive dust shield of this disclosure.

This method incorporates the approach of using a stretchable flexible fitting ring 110 as described above typically made of a rubber, vinyl, or stretchable polymer. It is circular and donut-like as illustrated in FIGS. 7A, 8, and 9. It may, but need not, have the slot 114 as illustrated in FIG. 7A. Taking the fitting ring 110 as illustrated in FIG. 8, a person would first place the fitting ring 110 over the bearing housing 68 or a grinder 60.

In situations where the inside diameter of the fitting ring 110 is greater than the diameter of the bearing housing 68, the fitting ring 110 easily slips thereover. The upstanding fingers 178 of the cover 170 are spread if necessary and placed around the outside diameter of the fitting ring 110 and released thereon. A suitable securing fastener 88, such as a hose clamp, is placed around the outside diameter of the upstanding fingers 178. It should be understood that the securing fastener 88 may be placed loosely around the upstanding fingers 178 before placement of the upstanding fingers 178 around the outside diameter of the fitting ring 110 to facilitate the process.

Once the securing fastener 88 is so placed, it is tightened around the upstanding fingers 178 thereby compressing the upstanding fingers 178 into the fitting ring 110 with the fitting ring 110 in turn compressing around and squeezing onto the bearing housing 68. Continued tightening causes the fitting ring 110 to compress and squeeze into the groove 69 thereby creating what has been termed herein as a mechanical connection.

In situations where the inside diameter of the fitting ring 110 is considerably smaller than the outside diameter of the bearing housing 68, because of the composition of the fitting ring 110, a person may cut through the fitting ring 110 to thereby permit that person to spread out the two ends of the fitting ring 110 and by so doing to increase the size of its inside diameter. The person then places the fitting ring 110 over and onto the bearing housing 68 and releases the spread ends causing them to retract onto the bearing housing. The steps of placement of cover 170 and securing fastener 88, as described above, follow.

Additionally, in situations where the outside diameter of the bearing housing 68 is considerably smaller than the inside diameter of the fitting ring 110, the person may merely cut off one or more segments of the fitting ring 110 until a suitably sized inside diameter for the fitting ring 110 is established. In cases where the outside diameter of the bearing housing 68 is extremely small, a second fitting ring 110 may be placed and secured over the first fitting ring. The clamping, compressing, and squeezing as described above caused by tightening of the securing fastener 88 establish a secure mechanical connection between all these parts.

This method as described above simplifies the entire process of attaching a dust shield onto any grinder regardless of the size of the diameter of the bearing housing 68.

The present disclosure includes that contained in the present claims as well as that of the foregoing description. Although this adaptive dust shield has been described in its preferred forms with a certain degree of particularity, it is understood that the present disclosure of the preferred forms has been made only by way of example and numerous changes in the details of construction and combination and arrangement of parts may be resorted to without departing from the spirit and scope of the adaptive dust shield. Accordingly, the scope of the adaptive dust shield should be determined not by the embodiment[s] illustrated, but by the appended claims and their legal equivalents.

Applicant[s] have attempted to disclose all the embodiment[s] of the adaptive dust shield that could be reasonably foreseen. It must be understood, however, that there may be unforeseeable insubstantial modifications to adaptive dust shield that remain as equivalents and thereby falling within the scope of the adaptive dust shield device 100.

What is claimed is:

1. An adaptive dust shield for rotary grinders having a bearing housing with a groove therein, said adaptive dust shield comprising:

(a) a cover having a defined diameter wherein said cover is adapted to encircle and cover a grinding disk attached to the rotary grinder;

(b) an upstanding collar on top of said cover, said upstanding collar having a Width-X wherein said Width-X is substantially less than said defined diameter;

(c) a plurality of upstanding flexible fingers in multiples of four on top of and around said upstanding collar, said plurality of upstanding flexible fingers having a Height H, and inside diameter of Width-A, and forming a broken circle around said upstanding collar wherein said Width-A is substantially less than said Width-X, said plurality of upstanding flexible fingers having a Width-W2 and being separated apart from each other defining a space between each one of said plurality of upstanding flexible fingers wherein said space has a Width-W1;

(d) securing means for securing said upstanding flexible fingers onto the bearing housing of the grinder;

(e) a stretchable fitting ring having an inside diameter, an outside diameter, an outer circumferential face, and a Height-E wherein said stretchable fitting ring is fit-able onto the bearing housing of the grinder and pressed into the groove as said securing means is applied and said plurality of upstanding fingers are pressed into engagement with said outer circumferential face of said stretchable fitting ring as said securing means is applied.

2. The adaptive dust shield as claimed in claim 1 wherein said stretchable fitting ring is comprised of materials selected from the group consisting of rubber, vinyl, and stretchable polymers.

3. The adaptive dust shield as claimed in claim 1 wherein said stretchable fitting ring has a slot therethrough thereby allowing for its said inside diameter to be increased to a greater diameter.

4. The adaptive dust shield as claimed in claim 1 wherein said Height-E of said stretchable fitting ring is equal to or less than said Height-H of said plurality of upstanding flexible fingers.

5. The adaptive dust shield as claimed in claim 1 wherein said outside diameter of said stretchable fitting ring is equal to or less than said Width-A.

6. The adaptive dust shield as claimed in claim 1 wherein said Width-W1 bears a ratio to said Width-W2 of approximately 1.00:1.25 to approximately 1.00:1.75.

7. The adaptive dust shield as claimed in claim 1 wherein said Width-W1 bears a ratio to said Width-W2 of approximately 1.00:1.56.

8. The adaptive dust shield as claimed in claim 1 wherein said plurality of upstanding flexible fingers and are comprised of materials selected from the group consisting of vinyl, rubber, and flexible polymers.

9. An adaptive dust shield for rotary grinders having a bearing housing with a groove therein, said adaptive dust shield comprising:

(a) a cover having a top, a downward extending skirt from said top, and a defined diameter for said skirt wherein said cover is adapted to encircle and cover a grinding disk attached to the rotary grinder;

(b) a ledge on said top of said cover with a plurality of upstanding flexible fingers in multiples of four on top of and around said ledge, said upstanding flexible fingers having a Height-H, and inside diameter of Width-A, and forming a broken circle around said ledge wherein said Width-A is substantially less than said defined diameter, said plurality of upstanding flexible fingers having a Width-W2 and being separated apart from each other defining a space between each one of said plurality of upstanding flexible fingers wherein said space has a Width-W1, with each said space between each one of said plurality of upstanding flexible fingers is formed partially through said top and extending upwardly such that each said space is generally "L"-shaped; and (c) securing means for securing said upstanding flexible fingers and onto the bearing housing of the grinder.

10. The adaptive dust shield as claimed in claim 9 wherein said Width-W1 bears a ratio to said Width-W2 of approximately 1.00:1.25 to approximately 1.00:1.75.

11. The adaptive dust shield as claimed in claim 9 wherein said Width-W1 bears a ratio to said Width-W2 of approximately 1.00:1.56.

12. The adaptive dust shield as claimed in claim 1 wherein said plurality of upstanding flexible fingers are comprised of materials selected from the group consisting of vinyl, rubber, and flexible polymers.

13. The adaptive dust shield as claimed in claim 9 further comprising a stretchable fitting ring having an inside diameter, an outside diameter, and a Height-E wherein said stretchable fitting ring is fit-able onto the bearing housing of the grinder and press into the groove as said securing means is applied and said plurality of upstanding fingers press into said stretchable fitting ring as said securing means is applied.

14. The adaptive dust shield as claimed in claim 13 wherein said stretchable fitting ring is comprised of materials selected from the group consisting of rubber, vinyl, and stretchable polymers.

15. The adaptive dust shield as claimed in claim 13 wherein said stretchable fitting ring has a slot therethrough thereby allowing for its said inside diameter to be increased to a greater diameter.

16. The adaptive dust shield as claimed in claim 13 wherein said Height-E of said stretchable fitting ring is equal to or less than said Height-H of said plurality of upstanding flexible fingers.

17. A method of attaching a dust shield having a cover with a top and a plurality of upstanding fingers on said top to a rotary grinder having a bearing housing with a surface area and a groove on said bearing housing comprising the steps of:

(a) obtaining a stretchable fitting ring having an outside circumferential face, an inside circumferential face, a height as to cover a substantial portion of said surface area and being of a substantial thickness, and placing said stretchable fitting ring onto said bearing housing such that said inside circumferential face is in contact with said bearing housing;

(b) placing said plurality of upstanding fingers around the outside circumferential face of said stretchable fitting ring; and (c) placing a securing fastener around said plurality of upstanding fingers, either before or after placing said plurality of upstanding fingers around the outside circumferential face of said stretchable fitting ring, and tightening said securing fastener around said plurality of upstanding fingers and compressing said plurality of upstanding fingers onto said stretchable fitting ring and compressing said stretchable fitting ring onto said bearing housing.

18. The method as claimed in claim 17 wherein said stretchable fitting ring is comprised of materials selected from the group consisting of rubber, vinyl, and stretchable polymers.

19. The method as claimed in claim 17 further comprising the step of tightening said securing fastener such that said stretchable fitting ring compresses into said groove.

20. The method as claimed in claim 17 further comprising the step of cutting said stretchable fitting ring completely through before placing said stretchable fitting ring onto said bearing housing.

21. The method as claimed in claim 17 further comprising the step of cutting one or more sections from said stretchable fitting ring before placing said stretchable fitting ring onto said bearing housing.

* * * * *